United States Patent [19]

Kato et al.

[11] Patent Number: 4,937,625

[45] Date of Patent: Jun. 26, 1990

[54] DEVELOPING DEVICE FOR COPIER

[75] Inventors: Keiji Kato; Yoshikazu Nishikawa, both of Nara; Akio Shiomi, Kyoto; Toyoka Aimoto, Nara, all of Japan

[73] Assignee: Sharp Kabushiki Kaisha, Osaka, Japan

[21] Appl. No.: 233,074

[22] Filed: Aug. 17, 1988

[30] Foreign Application Priority Data

Aug. 28, 1987 [JP] Japan ..... 62-131659[U]
Sep. 22, 1987 [JP] Japan ..... 62-145082[U]
Sep. 22, 1987 [JP] Japan ..... 62-145134[U]

[51] Int. Cl.[5] ..... G03G 15/06

[52] U.S. Cl. ..... 355/245; 118/656; 355/260

[58] Field of Search ..... 118/612, 658, 657, 653, 118/656; 355/3 DD, 14 D; 366/299, 300, 298; 222/DIG. 1

[56] References Cited

U.S. PATENT DOCUMENTS 4,711,551 12/1987 Fujio et al. ..... 118/653 X

*Primary Examiner*—Arthur T. Grimley
*Assistant Examiner*—Robert Beatty
*Attorney, Agent, or Firm*—Flehr, Hohbach, Test, Albritton & Herbert

[57] ABSTRACT

A developing device for developing a toner image on a cylindrical electrophotographic photoreceptor includes a toner container which extends perpendicularly to the direction of the photoreceptor and a toner transporting device for moving the toner supplied from the container in the direction of the axis of the photoreceptor. The toner transporting device and the container are detachably attachable to each other and a normally closed shutter is provided at the opening through which toner can be dropped from the container into the toner transporting device. The shutter can be automatically opened when a toner transporting unit having a shutter-opening mechanism is attached to it.

11 Claims, 10 Drawing Sheets

DEVELOPING DEVICE FOR COPIER

BACKGROUND OF THE INVENTION

This invention relates to a developing device for an electrophotographic image formation apparatus such as a copier and a laser printer for applying toner to an electrostatic latent image formed on a photoreceptor by exposure thereof to an image-forming beam of light.

A photoreceptor of the type most commonly used in electrophotography is cylindrical in shape and is frequently referred to simply as a drum. A developer roller for forming a magnetic brush on its surface is disposed parallel to such a cylindrical photoreceptor and means for supplying toner to this developer roller is usually disposed thereabove and extending parallel thereto. With the toner supply means thus disposed along the axis of the developer roller, however, care must be taken such that the image forming beam is not blocked thereby and prevented from reaching the photoreceptor so as to form an electrostatic latent image thereon. In view of the above, the region which is exposed to the incident beam and the region where development takes place by the developer roller are separated by a large distance, but this does not allow the copier to be designed compactly.

A developing device is usually comprised of a housing and a container for containing a fresh supply of developing agent to be supplied into the housing which includes not only a developing tank containing the aforementioned developer roller and a supply tank for supplying developing agent into the developing tank. When the copier is used for monochromatic printing in a different color, however, the user must normally remove the entire developing device with both its housing and its container and replace it by another one for the desired color. Since the developing device is not small, it is a cumbersome job to exchange developing devices and a large space is required to store a removed developing device.

SUMMARY OF THE INVENTION

It is therefore an object of the present invention to provide a developing device which, having a large enough container for a fresh supply of developing agent, still allows the copier as a whole to be compactly designed.

It is another object of the present invention to provide a developing device in which blocking of toner is less likely to occur.

It is a further object of the present invention to provide a developing device which can be easily exchanged for another for monochromatic printing in a different color.

In order to allow a copier to be designed compactly, a developing device embodying the present invention is characterized as having a toner container which is not only disposed so as not to block the optical path inside the copier to the aforementioned exposure region, but also extended in a direction transverse to the axis of the cylindrical photoreceptor. With the toner container thus designed, the exposure region where an electrostatic latent image is formed can be close to the region where development actually takes place such that the copier can be compactly designed.

In order to transport toner smoothly along the length of the photoreceptor, two mutually parallel screws are rotated such that toner is pushed by one in one direction therealong and by the other in the opposite direction. If a partition plate is provided between these screws, a uniform circulating toner flow is established. If toner from the container is dropped on one of them and pushed to the other screw and then to a supply roller which rotates below the two screws, the screws are so structured and/or operated that the rate at which toner is transported by the second screw toward the supply roller is greater than that by the first screw toward the second screw. This serves to prevent blocking by toner between the second screw and the supply roller.

The container at the top and the lower unit containing a developing tank are detachable from each other. A shutter is provided at the outlet of the container through which toner can be dropped into the lower unit. The outlet is normally closed by the shutter, but when the lower unit is attached to the container, a mechanism at the top of the lower unit pushes the shutter to open the outlet. If the user usually prints in one color (such as black), but occasionally wishes to print in another color (such as red), a container containing black toner may be left attached to the copier and after the lower unit normally used for printing in black is removed, another lower unit containing red toner but not provided with the mechanism for opening the shutter is set in the copier. In this manner, the user is not required to replace the entire developing device for occasional use of different colors.

BRIEF DESCRIPTION OF THE DRAWINGS

The accompanying drawings, which are incorporated in and form a part of the specification, illustrate an embodiments of the present invention and, together with the description, serve to explain the principles of the invention. In the drawings.

A DETAILED DESCRIPTION OF THE INVENTION

Figure 1:
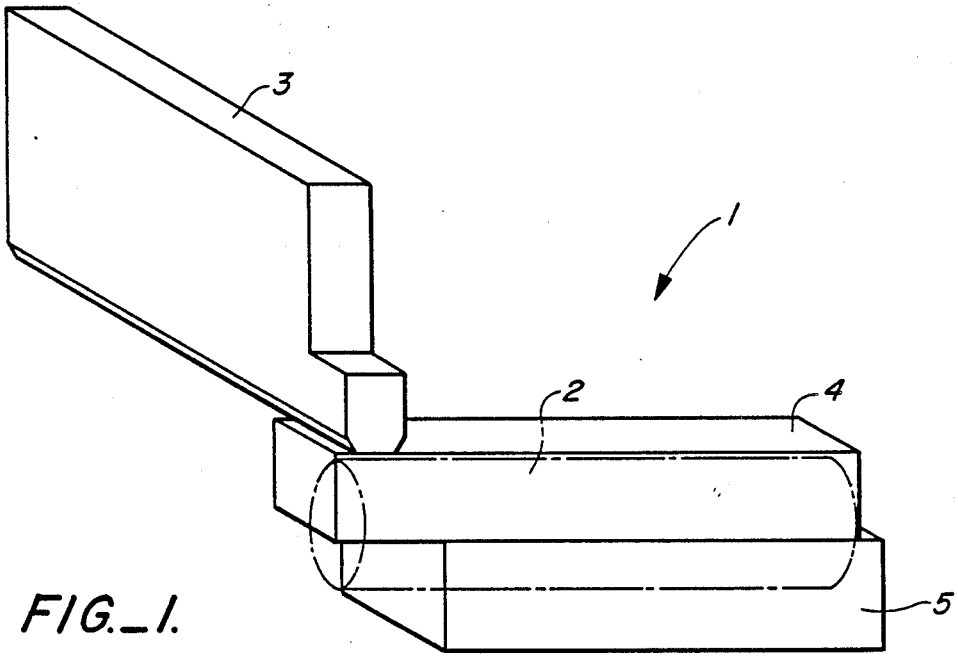
FIG. 1 is a schematic diagonal view of a developing device embodying the present invention.

In FIGS. 1–4, numeral 1 generally indicates a developing device embodying the present invention characterized as having a toner container 3 which extends perpendicularly to the axial direction of a cylindrical photoreceptor 2. Numeral 4 indicates a transporting means for transporting the toner from the container 3. Numeral 5 indicates a developing tank with its casing shown at 5a in FIGS. 2 and 4. Disposed inside the casing 5a are a developer roller 15 for developing an electrostatic latent image formed on a photoreceptor 2, two stirrer rollers 16 and 17 for stirring the toner inside the casing 5a and a regulating plate 18 for uniformly regulating the thickness of the toner layer on the surface of the developer roller 15.

Figure 3:
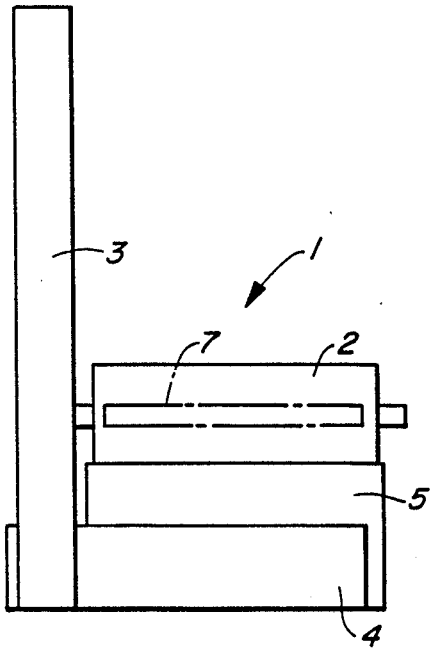
FIG. 3 is a schematic plan view of the developing device of FIG. 1.

The transporting means 4 is elongated parallel to the axial direction of the photoreceptor 2 and its left-hand end extends beyond the developing tank 5 as shown in FIG. 3. The toner container 3, which extends perpendicularly thereto, is attached to the aforementioned left-hand end part of the transporting means 4, extending beyond the developing tank 5 so as not to block the exposure region 7 formed on the photoreceptor 2. In other words, the present invention allows the container 3 to be as large as necessary without changing the optical path of the image-forming beam of light reaching the exposure region 7.

Disposed inside the toner container 3 as shown in FIG. 1 are a stirrer shaft 12 for stirring toner and a transporting screw 13 for causing the toner container with the container 3 to be transported by the transporting means 4. Numeral 14 in FIG. 2 indicates a motor by which both the stirrer shaft 12 and the transporting screw 13 are rotationally driven. The screw 13 is composed of a shaft 13a and a helically spiralling vane 13b protruding from the shaft 13a such that, as the screw 13 is rotated by the motor 14, toner inside the container 3 is pushed in the direction of the arrow A in FIG. 4 to an end section 19 thereof.

The mechanism for attaching the toner container 3 to the developing device 1 is explained next by way of FIGS. 5A and 5B. At the end section 19 of the container 3 on the bottom surface is an opening 20 through which toner is dropped from the interior of the container 3 to the toner transporting means 4. A cap 21 is provided around the end section 19 and is biased by a biasing means (not shown) in the direction of the edge such that, when the container 3 is moved from the developing device 1, as shown in FIG. 5A, the cap 21 moves toward the edge of the cover of the opening 20, preventing toner from dropping out therethrough.

Figure 5A:
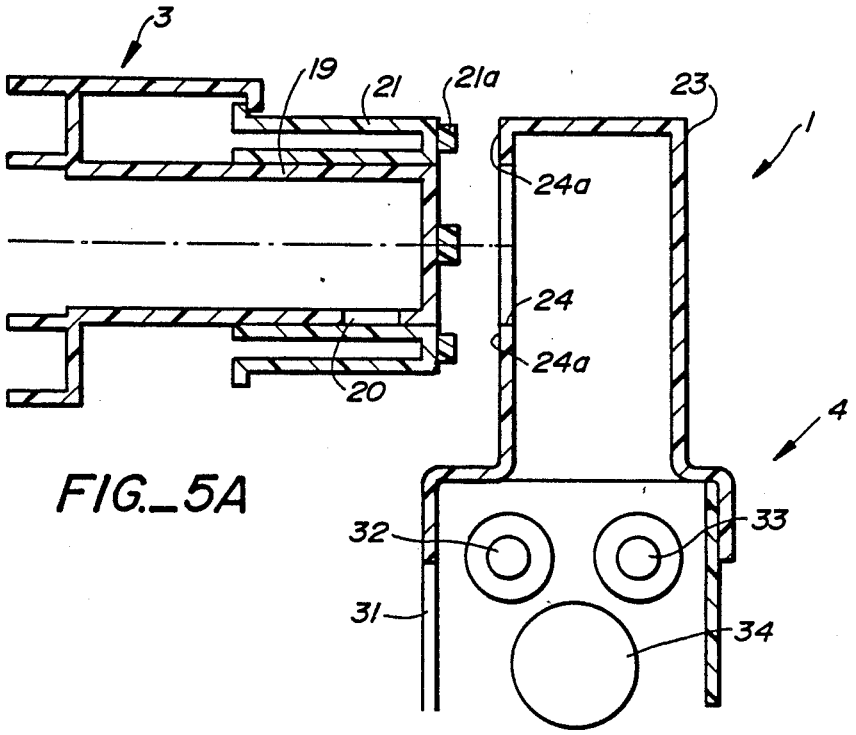
FIG. 5A and 5B are sectional views of a part of the developing device of FIG. 1 where the toner-transporting means is attached to the toner container.
Figure 5B:
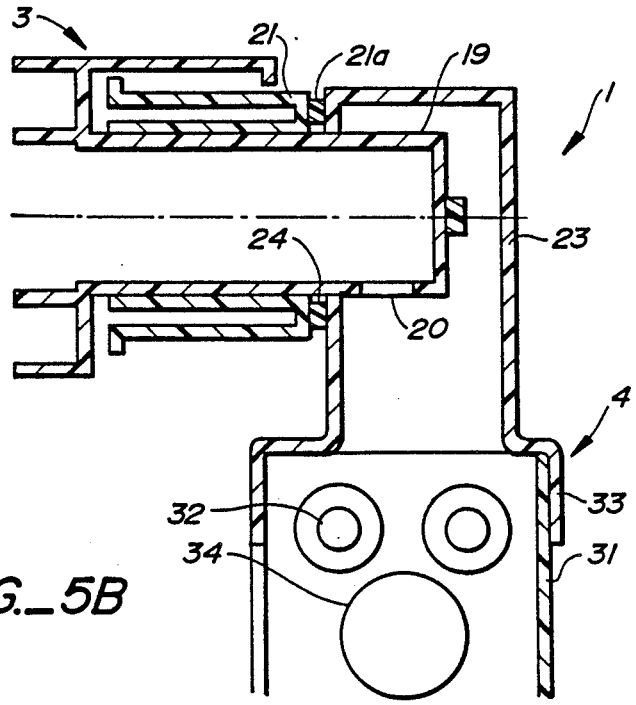

When the toner container 3 is attached to the developing device 1, the end section 19 of the container 3 is placed opposite to a guide hole 24 in a guide member provided to the transporting means 4 as shown in FIG. 5A and the end section 19 is moved into the guide member 23 while contact pads 21a on the forward end surface of the cap 21 are pressed against an outer wall 24a around the guide hole 24 as shown in FIG. 5B. Thus, the opening 20 on the end section 19 now within the guide member 23 is open such that toner can be dropped therethrough to be discharged into the toner transporting means 4.

Figure 6:
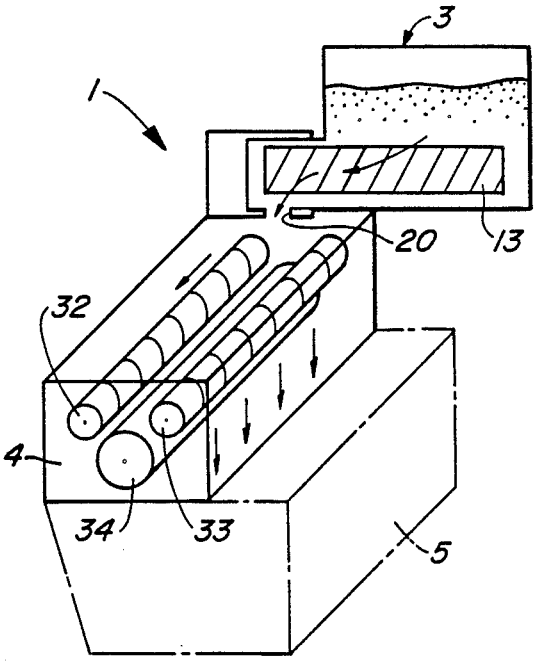
FIG. 6 is a schematic diagonal view of some of the components of the developing device of FIG. 1.
Figure 2:
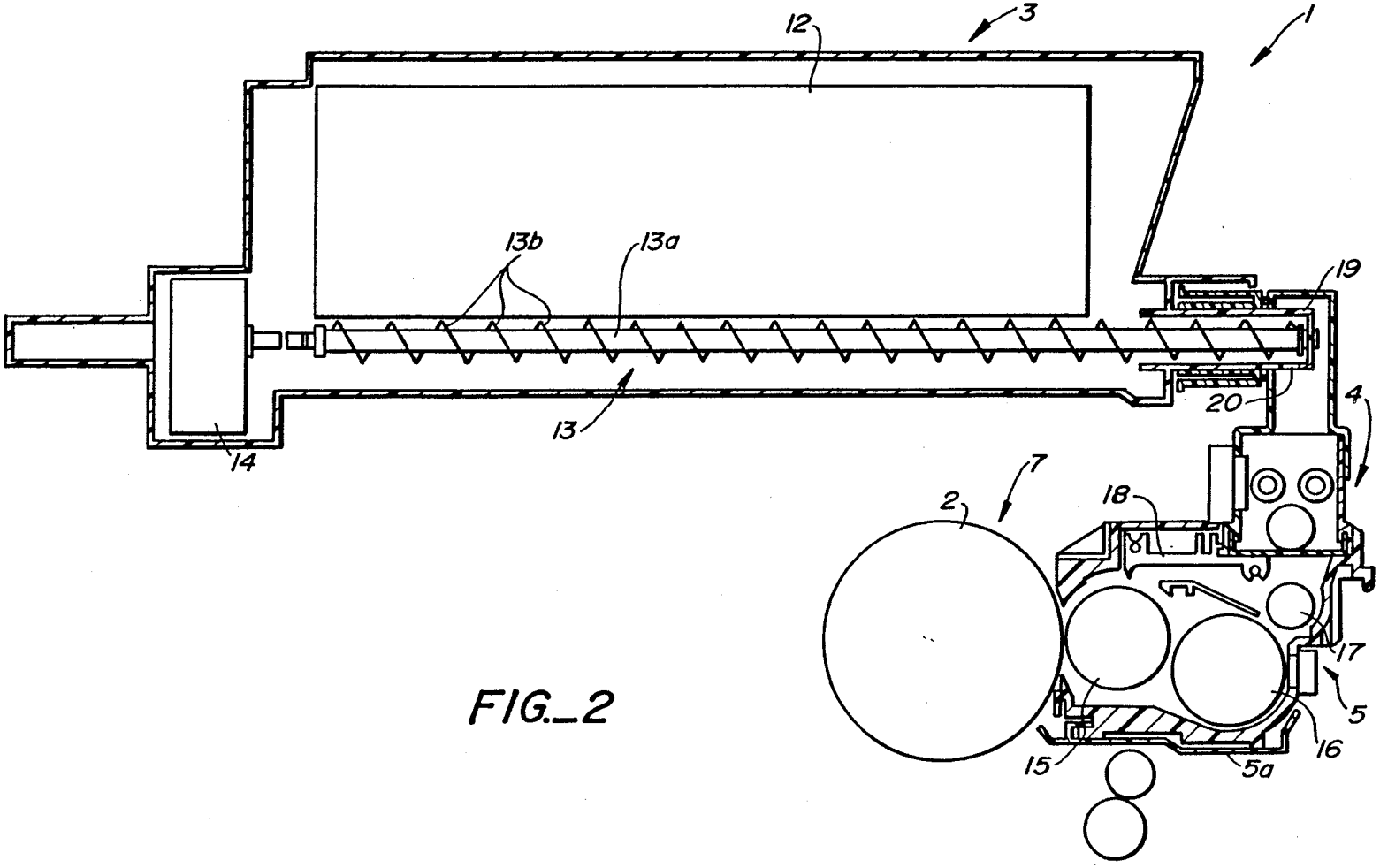
FIG. 2 is a sectional front view of the developing device of FIG. 1.
Figure 4:
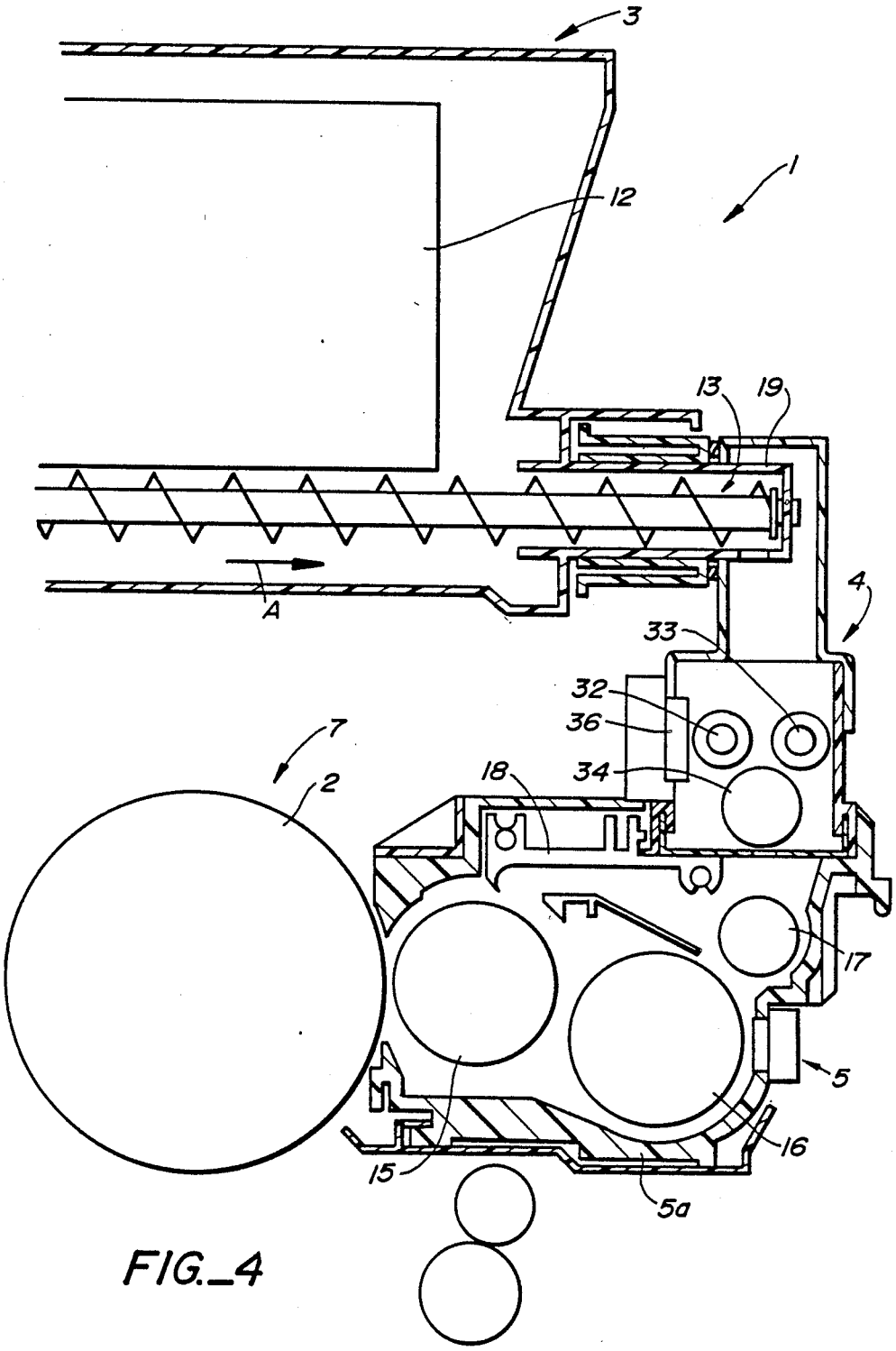
FIG. 4 is a portion of FIG. 2 shown enlarged.
Figure 7:
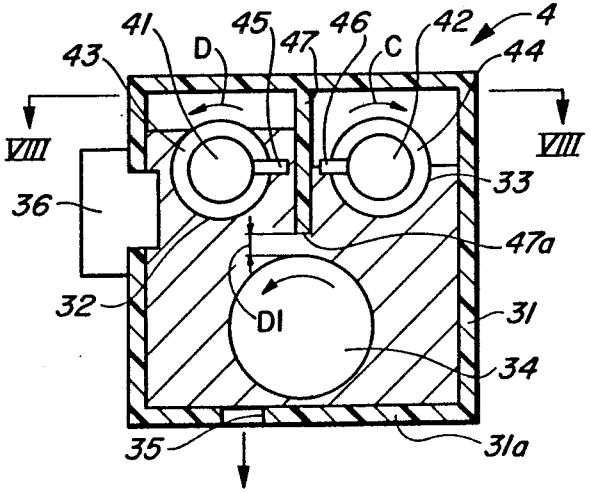
FIG. 7 is a longitudinal sectional view of the toner-transporting means shown in FIG. 6.
Figure 8:
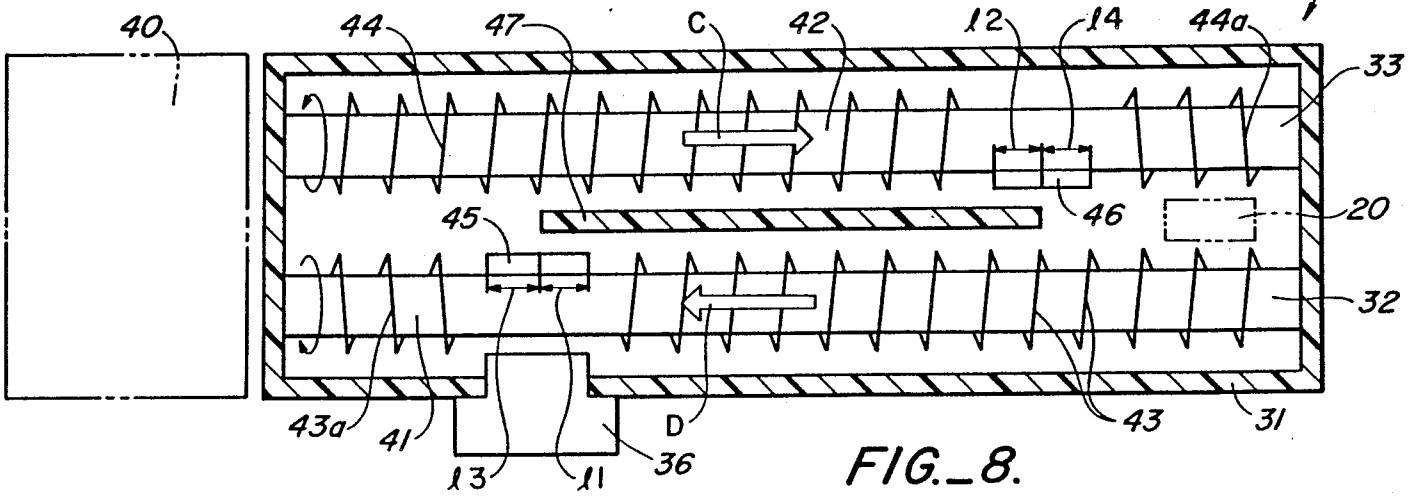
FIG. 8 is a sectional view of the toner-transporting means taken along the line VIII—VIII of FIG. 7.

As shown in FIGS. 6–8, the toner-transporting means 4 includes within its casing 31 two toner-transporting screws 32 and 33 which are disposed horizontally and mutually parallel to each other. A toner supply roller 34 made of an sponge-like material is disposed below the transporting screws 32 and 33 and at equidistance from their axes. The bottom plate 31a of the casing 31 is provided with an elongated opening 35 along the entire length of the supply roller 34 and somewhat toward the screw 32 (away from the other screw 33) such that the toner can be dropped therethrough into the developing tank 5.

On one (left-hand) side surface of the casing 31 is a sensor 36 for detecting the amount of remaining toner and adapted to activate the toner motor 14 if it detects that the toner inside the casing 31 is less than a specified level, thereby causing toner to be supplied through the opening 20 into the transporting means 4.

The screw 32 is composed similarly of a shaft 41 and a vane 43 helically spiralling therearound. As shown in FIG. 8, however, the vane 43 is missing near the left-hand end where a stirrer plate 45 protrudes. Further towards the left-hand end, the shaft 41 is provided with a shorter vane 43a spiralling in the opposite direction.

The other screw 33 is similarly structured with a shaft 42 and a vane 44 which helically spirals around the shaft 42 except near the right-hand end where another stirrer plate 46 protrudes. Further towards the right-hand end, the shaft 42 is provided with an oppositely spiralling shorter vane 44a.

The transporting screws 32 and 33 thus structured are driven by a driving means (shown schematically at 40 in FIG. 8) in mutually opposite directions C and D such that the toner dropped into the transporting means 4 through the opening 20 is transported in the direction of the arrow D by the screw 32, scraped up by the stirrer plate 45 to be sent across toward the other screw 33, transported in the direction of the arrow C by the screw 33, and scraped up by the stirrer place 46 to be sent across toward the screw 32. In summary, toner is moved around inside the casing 31 by the two parallel screws 32 and 33. Toner at the end section inside the casing 31 is moved toward the stirrer plates 45 and 46 respectively by the vanes 43a and 44a. A partition plate 47 is provided between the two screws 32 and 33, extending approximately to the centers of the stirrer plates 45 and 46 such that the aforementioned smooth circulating toner motion can be established without fluctuations in the toner level. Without this partition plate 47, toner particles being pushed in mutually opposite directions by the two screws 32 and 33 would collide with each other and stagnate in the middle. If the length of the portions of the partition plate 47 overlapping with the stirrer plate 45 and 46 are $l_1$ and $l_2$ and those of the stirrer plates 45 and 46 not overlapping with the partition plate 47 are respectively $l_3$ and $l_4$ as shown in FIG. 8, experiments by the inventors showed that the best results (and smoothest circulating flow) can be obtained when $l_1=l_3$ and $l_2=l_4$. It has also been ascertained that fluctuations in the amount of toner dropping from the supply roller 34 through the opening 35 can be reduced if the vertical separation $D_1$ shown in FIG. 7 between the bottom edge 47*a* of the partition plate 47 and the top surface of the supply roller 34 is less than 1 mm. With the toner transporting means 4 thus structured and operated, toner particles supplied thereinto through the opening 20 at one end thereof can be dropped uniformly along the length of the developing tank 5, that is, the axial direction of the photoreceptor 2 so as to improve the image quality of the toner image developed thereon.

Figure 9:
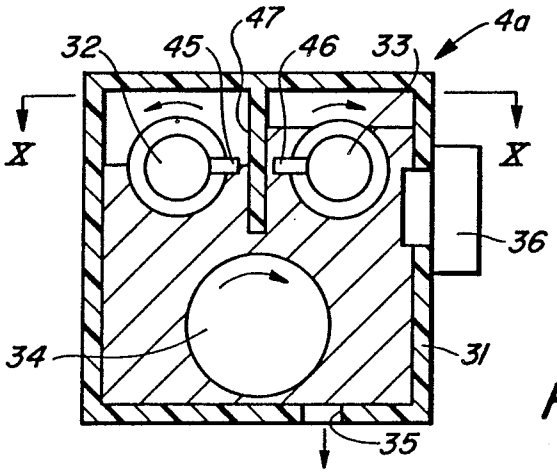
FIG. 9 is a sectional view of another toner-transporting means embodying the present invention.
Figure 10:
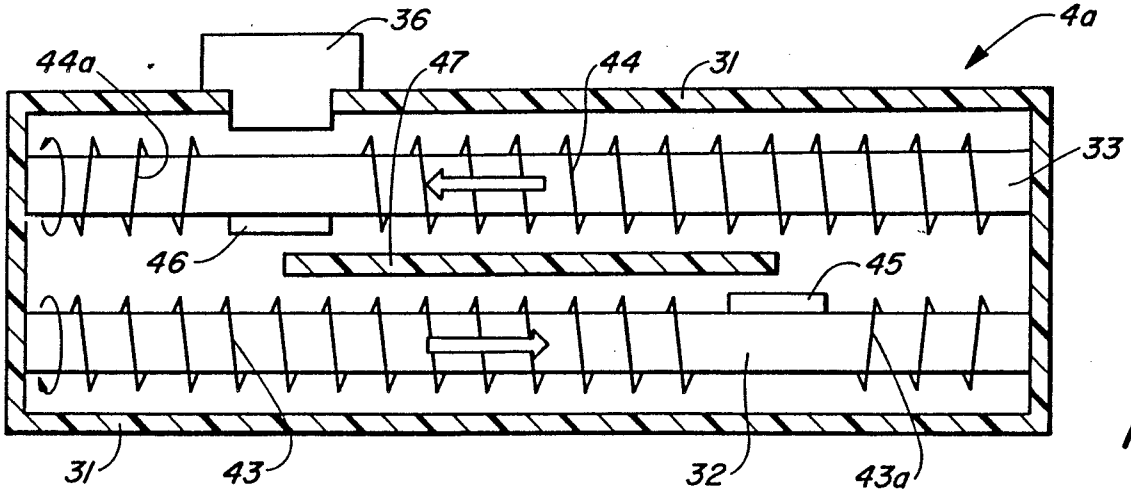
FIG. 10 is another sectional view of the toner-transporting means of FIG. 9 taken along the line X—X of FIG. 9.

The foregoing description of a preferred embodiment of the invention has been presented for purposes of illustration and description. It is not intended to be exhaustive or to limit the invention to the precise form disclosed, and many modifications and variations are possible in light of the above teaching. For example, the transporting means 4 may be formed alternatively as shown in FIGS. 9 and 10 wherein components which may be identically structured are indicated by the same numerals. The transporting means 4 shown in FIGS. 9 and 10 are different in that the screws 32 and 33 and the supply roller 34 are rotated in opposite directions and that the bottom opening 35 is placed differently. It should be easily understandable that the transporting means 4 shown in FIGS. 9 and 10 is equally effective in serving the purposes of the present invention.

Figure 11:
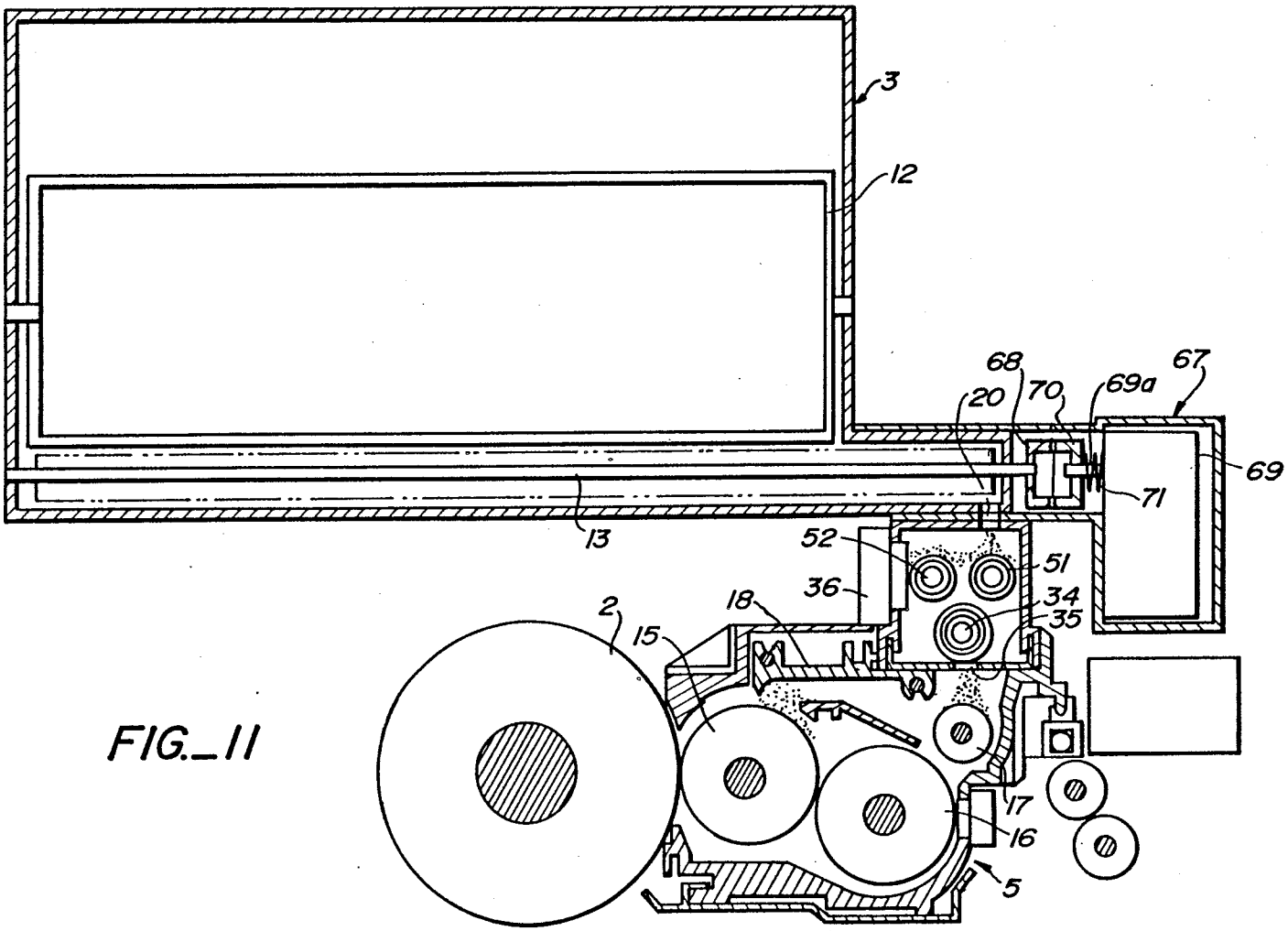
FIG. 11 is a sectional front view of another developing device embodying the present invention.
Figure 12:
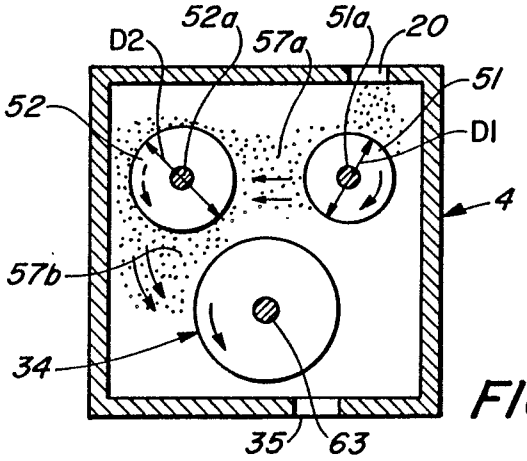
FIG. 12 is a longitudinal sectional view of a part of the developing device of FIG. 11.
Figure 13:
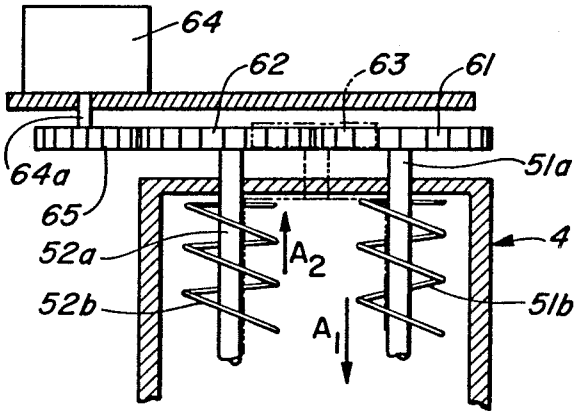
FIG. 13 is a sectional plan view of the developing device of FIGS. 11 and 12.

FIG. 11 shows still another developing device embodying the present invention wherein components which are comparable to those described above are also indicated by the same numerals for convenience. As shown in FIGS. 12 and 13 more in detail, its toner transporting means 4 is characterized as having no partition plate in the middle. Instead, a toner inlet opening 20 is provided above a first screw 51 for transporting toner in the direction of the arrow A1 in FIG. 13 and a (first) gap 57*a* is provided between this first screw 51 and a second screw 52 which is disposed parallel to the first screw 51 and is operated to transport toner therealong in the direction of the arrow A2 shown in FIG. 13 such that toner is transported from the first transporting screw 51 to the second transporting screw 51 across this gap 57A. Between the second transporting screw 52 and the toner supply roller 34 is another (second) gap 57*b* such that toner is transported from the second transporting screw 52 to the supply roller 34.

If the two screws 51 and 52 are rotated at the same rate and if the diameter $D_2$ of the second screw 52 is the same as or smaller than the diameter $D_1$ of the first screw 51, toner motion tends to become blocked at the second gap 57*b*. After a long continuous use, this may cause fluctuations in the amount of toner dropped by the supply roller 34 into the developing tank 5. According to the present invention, therefore, the screws 51 and 52 are structured and/or operated such that the rate of toner transportation across the second gap 57*b* by the second screw 52 is greater than that across the first gap 57*a* by the first screw 51. According to one embodiment of the present invention, the diameter $D_2$ of the second screw 52 is made larger than the diameter $D_1$ of the first screw 51 as shown in FIG. 12 such that the peripheral speed of the second screw 52 is greater than that of the first screw 53.

As shown in FIGS. 12 and 13, the first screw 51 is composed of a shaft 51*a* and a helically spiralling vane 51*b* and the second screw 52 is similarly composed of a shaft 52*a* and a vane 52*b* helically spiralling in the same direction as the vane 51*b*. A first gear 61 affixed to the shaft 51*a* and a second gear 62 affixed to the shaft 52*a* are of the same diameter and engaged together. Numeral 63 indicates a gear affixed to the shaft of the supply roller 34 and engaged to the first gear 61. Numeral 65 indicates a gear attached to the drive shaft 64*a* of a motor 64 and engaging with the second gear 62.

In FIG. 11, numeral 67 generally indicates a driver means for the transporting screw 13 inside the container 3 comprised of a first gear 68 attached to the shaft 13*a* of the transporting screw 13, a toner motor 69, a second gear 70 attached to the drive shaft 69*a* of the toner motor 69 and engaged with the first gear 68 and a spring 71 biasing the second gear 70 in the direction of staying engaged with the first gear 68.

Figure 14:
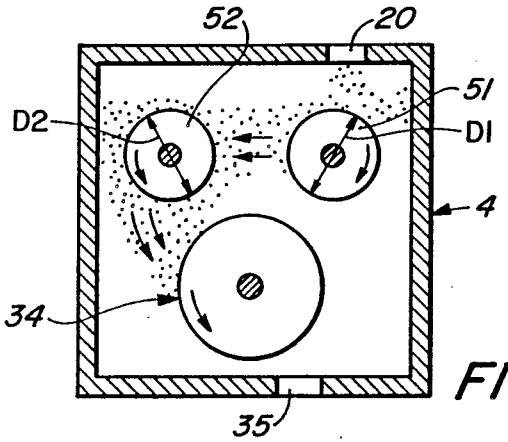
FIG. 14 is a longitudinal sectional view of a part of still another developing device embodying the present invention.
Figure 15:
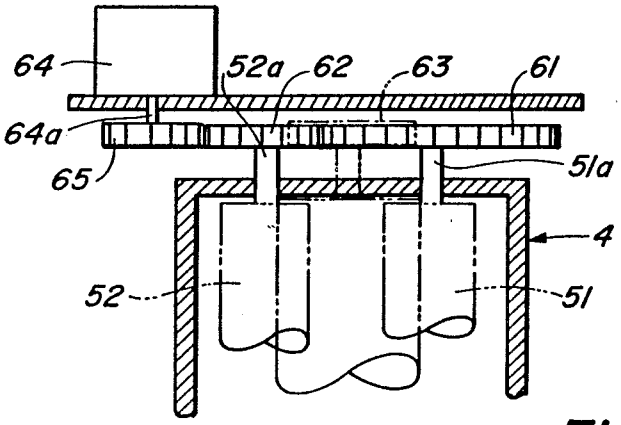
FIG. 15 is a plan sectional view of a part of the developing device of FIG. 14.

FIGS. 14 and 15 show a transporting means 4 according to still another embodiment of the present invention, characterized as having the first and the second toner transporting screws 51 and 52 of the same diameter, or $D_1=D_2$ in FIG. 14, but the first gear 61 is smaller than the second gear 62 such that the peripheral speed of the second screw 52 is greater than that of the first screw 51 and hence the toner is transported sufficiently fast across the second gap 57*b*, causing no blocking there.

Figure 16:
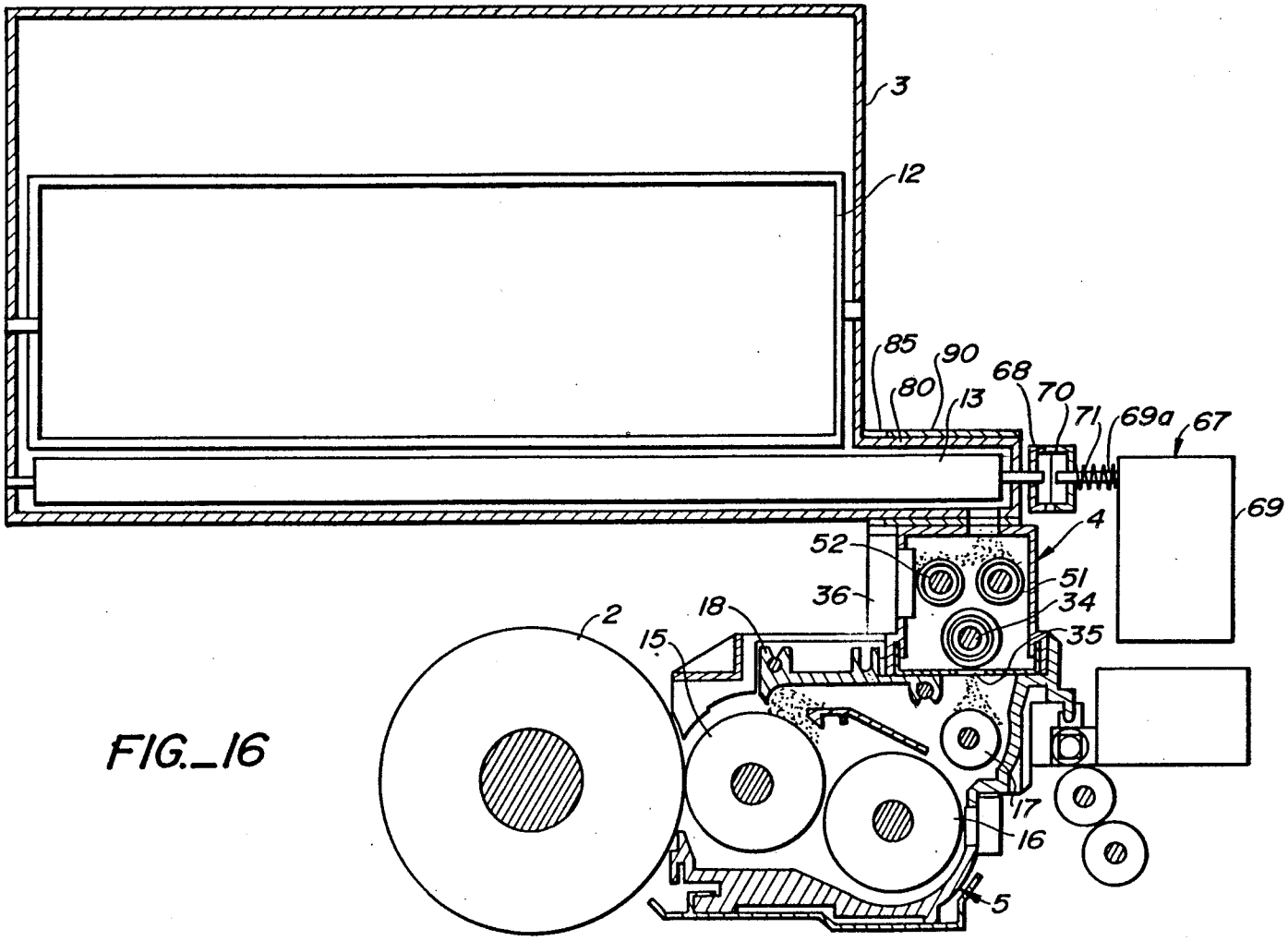
FIG. 16 is a sectional front view of still another developing device embodying the present invention.
Figure 18:
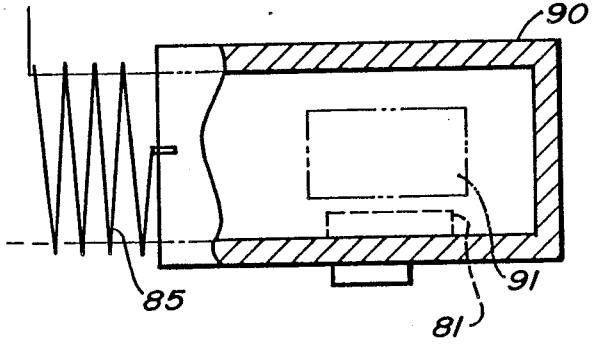
FIG. 18 is a sectional front view of the shutter of FIG. 17 in closed condition.

FIG. 16 shows still another developing device embodying the present invention especially convenient for printing in a different color. Components which are identical or substantially interchangeable with those already described above are indicated by the same numerals. The developing device shown in FIG. 16 is characterized as having a tubular shutter 90 which rotatably engages with the cylindrical outer surface of a horizontally protruding section 80 of the toner container 3.

Figure 20:
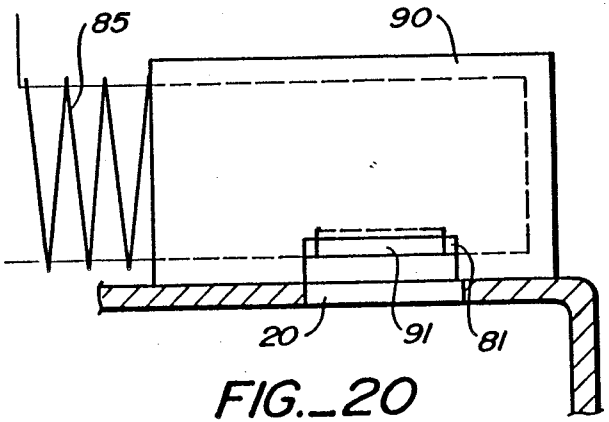
FIG. 20 is a sectional front view of the shutter of FIGS. 16–19 in open condition.
Figure 19:
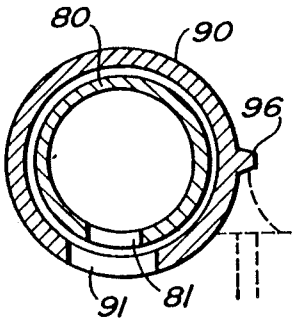
FIG. 19 is another sectional view of the shutter of FIGS. 16–18 in open condition.

An opening 81 is provided to this protruding section 80 through which toner is dropped from the interior of the container 3 into the transporting means 4. As shown in FIGS. 17–20, the tubular shutter 90 has a slit 91 formed on its periphery such that, as the shutter 90 is rotated slidingly around the cylindrical outer surface of the protruding section 80, the slit 91 can be brought opposite to the opening 81 in the protruding section 80 as shown in FIGS. 19 and 20 such that the shutter 90 is in open condition and toner can be discharged from container 3. If the shutter 90 is so rotated that its slit 91 is in the position shown in FIGS. 17 and 18, for example, the shutter 90 is in closed condition and toner inside the container 3 cannot be discharged. A coil spring 85 is provided to supply a biasing force on the shutter 90 so as to normally keep the shutter 90 in the closed condition shown in FIGS. 17 and 18.

Figure 17:
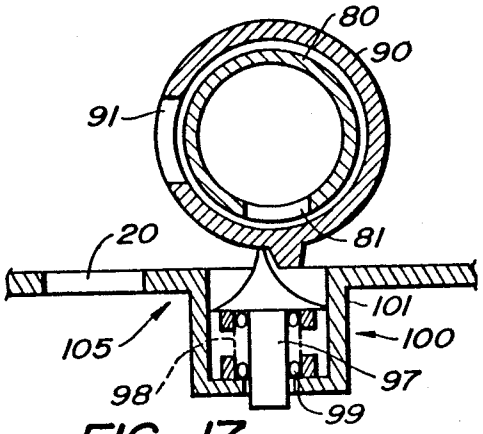
FIG. 17 is a sectional view of the shutter of FIG. 16 and components therearound when the shutter is in closed condition.

As shown in FIG. 17, a protrusion 96 is formed on the cylindrical outer peripheral surface of the shutter 90 and a retractable rod 97 is protrudingly supported by the ceiling of the toner transporting means 4. Numeral 98 indicates a compression spring which applies biasing force on the rod 97 in the direction of protruding toward the shutter 90. Numeral 100 generally indicates a supporting assembly including a seat 99 for the aforementioned biasing spring 98 and a guiding plate for retractably protruding rod 97. Springs 85 and 98, the protrusion 96 on the shutter 90, the rod 97 and the supporting assembly 100 may together be referred to as the shutter-controlling means 105. The top of the protruding rod 97 is shaped like an umbrella which serves to engage with the protrusion 96 on the shutter 90 so as to lift it as shown in FIG. 19 against the compressive force of the compression spring 98.

Next, a manner in which the developing device structured as described above can be very conveniently used is explained by way of an example where the copier is usually used to print monochromatically in black and occasionally in red. When a container 3 containing black toner is inserted into the copier, if there is no developing tank 5 attached to it, the shutter 90 is in the closed condition as explained above because the coil spring 85 keeps the protrusion 96 on the shutter 90 in the downward position as shown in FIG. 17. For normal copying in black, the user inserts a developing tank 5 for printing in black. When it is placed against the bottom surface of the container 3, the rod 97 at its top which is protruding upward by the elastic force of the compression spring 98 comes into contact with the outer peripheral surface of the shutter 90. As the developing tank 5 is pushed upward to be properly positioned, the rod 97 is pushed down against the biasing force of the compression spring 98 and simultaneously comes into contact with the protrusion 96 on the shutter 90 as shown in FIG. 17. As the developing tank 5 is further pushed upward to be properly positioned with respect to the container 3, the rod 97 is pushed up by the force of the compression spring 98 against the coil spring 85, causing the shutter 90 to rotate to assume the open position shown in FIG. 19. Black toner inside the container 3 flows into the developing tank 5 through the toner-transporting means 4.

When the user wishes to produce a copy in red, although this is not assumed to happen very often, the developing tank 5 for printing in black is removed from the copier. This means that the protrusion 98 on the shutter 90 loses its support from the rod 97 and the shutter 90 rotates back to the closed position shown in FIG. 17 by the biasing force of the coiled spring 85. Next, the user installs another developing tank (not separately shown) for printing in red characterized as not having the shutter control means 105 of the type described above. As a result, the shutter 90, which is a part of the container 3 as shown in FIG. 16, remains in the closed condition shown in FIG. 17 although the developing tank for printing in red is properly installed for use and the black toner inside the container 3 does not flow into the developing tank. Red toner is contained in the newly installed toner transporting means 4 and the desired copying in red is effected thereby.

In summary, a developing tank which is frequently used is provided with a shutter control means and toner supplied from the container set above is used for the printing. Developing tanks which are not frequently used, by contrast, are not provided with such means, but use the toner carried within themselves. Thus, the user does not have to exchange the entire developing device to make a copy in an infrequently used different color, but exchanges only the developing tank, leaving the container installed in the copier.

As stated generally above, the present invention is to be broadly construed. The shutter, for example, need not be structured exactly as described above, it may be flat instead of cylindrical such that it can be opened and closed by the motion of the developing tank as it is pushed in or out of the copier body. Any modifications and variations that may be apparent to a person skilled in the art are intended to be included within the scope of this invention.

What is claimed is:

1. A developing device for developing a toner image on a cylindrical photoreceptor having an exposure region defined thereon, said developing device comprising a container which extends transversely to said cylindrical photoreceptor, is disposed so as not to cover said exposure region and contains toner therein, a developing tank adjacent to said photoreceptor, said developing tank having a casing which contains therein a developer roller fore developing an image on said photoreceptor and stirrer rollers for stirring toner inside said casing, and a toner transporting means which extends parallel to said cylindrical photoreceptor and serves to receive toner from said container, to move said received toner parallel to said cylindrical photoreceptor and to supply said moved toner into said developing tank through an opening formed in said casing, said toner transporting means including a first screw and a second screw which are rotatably supported horizontally and parallel to each other, said first and second screws serving to move said received toner in mutually opposite directions therealong, and a toner supply roller disposed parallel to and below said first and second screws, said first and second screws having therebetween a first gap through which toner is transported from said first screw to said second screw, said second screw and said toner supply roller having therebetween a second gap through which toner is transported from said second screw to said toner supply roller, the rate of toner transport through said second gap by said second screw being greater than the rate of toner transport through said first gap by said first screw.

2. The developing device of claim 1 wherein said second screw has a larger diameter than said first screw and said first and second screws rotate at the same speed.

3. The developing device of claim 1 wherein said first and second screws have the same diameter and said second screw rotates faster than said first screw.

4. The developing device of claim 1 wherein said container and said toner transporting means are detachably attachable to each other, said container having an outlet, and said developing device further comprising a shutter means for selectably opening and closing said outlet.

5. The developing device of claim 4 further comprising a biasing means for normally keeping said outlet closed by said shutter means.

6. The developing device of claim 4 further comprising a shutter-controlling means for automatically opening said shutter means when said container and said toner transporting means are attached to each other.

7. The developing device of claim 5 further comprising a shutter-controlling means for automatically opening said shutter means when said container and said toner transporting means are attached to each other.

8. The developing device of claim 4 wherein said shutter means is movably attached to said container.

9. The developing device of claim 6 wherein said shutter-controlling means are attached to said toner transporting means.

10. A developing device for developing a toner image on a photoreceptor extending in a direction and having an exposure region defined thereon, said developing device comprising a container which extends transversely to said direction, is disposed so as not to cover said exposure region and contains unused toner therein, a developing tank adjacent to said photoreceptor, said developing tank having a casing which contains therein a developer roller for developing an image on said photoreceptor and stirrer rollers for stirring toner inside said casing, and a toner transporting means which extends in said direction and serves to receive unused toner from said container, to move said received unused toner in said direction and to apply said moved unused toner into said developing tank through an opening formed in said casing, said toner transporting means including a toner supply roller disposed in said direction, and toner circulating means for moving toner circulatingly above said toner supply roller around a partition plate such that said toner moves in one way along said direction on one side of said partition plate and in the opposite way along said direction on the other side of said partition plate, said partition plate being disposed above said toner supply roller and separated therefrom by a gap of less than 1 mm.

11. The developing device of claim 10 wherein said partition plate is elongated in said direction.

* * * * *